United States Patent [19]

Waller

[11] 4,231,436

[45] Nov. 4, 1980

[54] MARINE RISER INSERT SLEEVES

[75] Inventor: Michael R. Waller, Tulsa, Okla.

[73] Assignee: Standard Oil Company (Indiana), Chicago, Ill.

[21] Appl. No.: 879,669

[22] Filed: Feb. 21, 1978

Related U.S. Application Data

[63] Continuation of Ser. No. 723,397, Sep. 15, 1976, abandoned.

[51] Int. Cl.[2] ..... E21B 15/02

[52] U.S. Cl. ..... 175/7; 166/367; 138/149

[58] Field of Search ..... 166/0.5, 0.6, 367, 350, 166/357, 362; 175/7, 65, 67, 5; 138/45, 46, 137, 140, 106, 107, 149; 114/264, 265; 9/8 R, 8 P

[56] References Cited

U.S. PATENT DOCUMENTS

| | | | |
|---|---|---|---|
| 1,764,488 | 6/1930 | Zublin | 24/263 DQ |
| 2,185,522 | 1/1940 | Rollins | 138/46 X |
| 2,607,422 | 8/1952 | Parks et al. | 166/0.5 |
| 3,163,220 | 12/1964 | Haeber | 166/362 X |
| 3,285,337 | 11/1966 | Johnstone et al. | 166/362 X |
| 3,486,555 | 12/1969 | Vincent | 175/7 X |
| 3,601,187 | 8/1971 | Tidwell | 175/7 X |
| 3,705,623 | 12/1972 | van Eek et al. | 166/0.6 |
| 3,721,292 | 3/1973 | Ahlstone | 166/0.5 |
| 3,729,756 | 5/1973 | Cook et al. | 166/0.5 X |
| 3,809,170 | 5/1974 | Ilfrey et al. | 175/7 |
| 3,820,605 | 6/1974 | Barber et al. | 166/DIG. 1 |
| 3,884,512 | 5/1975 | Wesch | 166/242 |
| 3,971,576 | 7/1976 | Herd et al. | 175/7 X |
| 4,024,913 | 5/1977 | Grable . | |
| 4,060,140 | 11/1977 | Barrington | 175/7 |

*Primary Examiner*—Ernest R. Purser
*Assistant Examiner*—Richard E. Favreau
*Attorney, Agent, or Firm*—John D. Gassett

[57] ABSTRACT

Drilling operations are run in a riser pipe, e.g., 20 inches in diameter, which extends from a ship to an anchored wellhead assembly on the ocean floor. Various strings of casing for lining the borehole wall are run down through the interior of the riser pipe. The first string of casing run is of relatively large diameter, e.g., 9-$\frac{5}{8}$ inches in diameter. Each successive string of casing which is run in this particular well is progressively smaller in diameter. Ideally, one would need a new and smaller riser in order to maintain about the same drilling fluid upward velocity. A high upward fluid velocity can be maintained by placing sleeve inserts in the annulus space between the drill string and the riser pipe interior wall. Additional strings of sleeves may be run inside the original sleeve to obtain a multiple effective sizing of the riser pipe.

6 Claims, 4 Drawing Figures

MARINE RISER INSERT SLEEVES

This is a continuation, of application Ser. No. 723,397, filed Sept. 15, 1976 now abandoned.

BACKGROUND OF THE INVENTION

Field of the Invention

This invention relates to drilling in earth formations located beneath a body of water, such as in the Gulf of Mexico, and in which the drilling operations are conducted from a floating structure. More specifically, this invention relates to a method and apparatus involving a riser pipe which extends from the ocean floor to the floating vessel located at the surface of the body of water. It relates especially to a novel riser pipe in which there are means for varying the effective size of the riser.

Setting

In recent years, it has become desirable to use a floating vessel from which to drill wells in marine locations. In such operations, the floating vessel is sometimes connected to a submerged wellbore by a long tubular member through which drilling tools, drilling fluids, etc., pass between the vessel and the wellbore. This long tubular member is commonly referred to as a riser pipe. The vessel is maintained on location normally by long cables which are connected to anchors in the ocean floor. Alternatively, dynamic positioning units can be provided for the vessel.

The submerged wellhead usually includes a blowout preventer and other control equipment. In one embodiment, the upper part of the wellhead assembly includes a ball connector which provides a flexible connection between the wellhead assembly and the riser pipe. The lower end of the riser pipe is connected to this ball joint and is free to pivot thereabout. This is commonly called a flex joint. Other types of flex joints are commercially available; however, the ball and socket joint is most widely used. Although a vessel is anchored, it can have vertical movement of from a few feet up to 25 to 30 feet or more. To compensate for this vertical movement, a slip or telescopic joint is provided in the riser pipe. The slip joint is usually located at the top of the riser pipe so that it can be serviced more easily than if it were placed at the bottom.

If the conventional riser pipe is supported solely at its lower end, its only effective weight, i.e., weight in water, causes it to be in a state of axial compression increasing from zero at the top to a maximum at the bottom support. A drilling fluid is normally circulated down the drill string within the riser pipe and carries rock cuttings back up to the surface in the annular space between the riser pipe and the external wall of the drill string. The greater the volume of this annular space, the lower the upward velocity of the drilling fluid for a given drilling mud pump capacity. The weight of this drilling fluid may vary from about 7½ pounds per gallon up to about 13, 15, or more pounds per gallon. The weight of the drilling mud also has an effect on the buckling strength in the wall of the riser pipe. To counteract this buckling effect, it has become a practice to apply a tensile force to the top of the riser pipe. Special tensioning devices are mounted on the ship and have their cables attached to the upper end of the riser pipe but below the slip joint. These tensioning devices are commonly referred to as "constant tensioning devices" so that they can maintain a constant tension on the riser pipe, although the ship may rise and fall with respect to the riser pipe.

PRIOR ART

The closest prior art of which I am aware is U.S. Pat. No. 3,729,756, issued May 1, 1972, entitled "Flotation Assembly" Cook, et al. This patent describes a collar to be placed around the riser pipe and comprises a pair of semiannular flotation members, each of which includes a semicircular outer shell of fiberglass, a semiannular low density core preferably including a plurality of plastic hollow spheres surrounded by synthetic foam, and arcuately shaped clamping means embedded in the core. This, of course, has no effect on the rate of flow of drilling fluid within the riser pipe. Saltwater flow tests have been conducted through pipe reduced by sleeves to various internal diameters. However, I know of no prior art which teaches to modify the interior of a riser pipe to reduce its effective size in a manner as taught herein.

RELATED APPLICATION

The subject matter of this invention is similar to copending Patent Application Ser. No. 723,400, entitled Riser Pipe Inserts, filed Sept. 15, 1976, Johnce E. Hall and William D. Greenfield, inventors, U.S. Pat. No. 4,086,971.

BRIEF DESCRIPTION OF THE INVENTION

This invention concerns a marine riser pipe for connection between a subsea wellhead and a floating vessel and through which drilling operations are conducted. Drilling operations are then conducted through the riser pipe until a sufficient depth of hole is drilled where it is found desirable to set a string of casing. A string of casing is run through the riser pipe and the first string of casing set is the largest string, of course, because subsequent strings of casing must be run through the previously set casing string. As soon as the larger string of casing has been run, it would be desirable to have a smaller riser pipe to maintain the desired upward velocity of drilling fluid in the annulus between the drill pipe and the riser. However, it is rather impractical to pull the old riser pipe and run a new and smaller riser. I therefore run a first sleeve insert inside the riser, which is made of a material which is only slightly denser than sea water. This reduces the volume of the drill pipe/-riser annulus. It also replaces heavy mud with a lightweight sleeve which reduces the tension needed to be applied to the riser pipe. The internal diameter of the sleeve insert is about the same diameter as that of the first string of casing set. I then drill the hole deeper through the interior of the first sleeve insert until a sufficient depth is run where it is desirable to run a second string of casing. I then run a second string of casing through the first sleeve insert. Thereafter, I run another sleeve insert similar to the first sleeve but smaller, of course, inside the first sleeve. This procedure is repeated for each additional string of casing run.

If I fill the riser pipe with sea water prior to placing the sleeves, I have no trouble in placing the sleeves if their density is slightly greater than sea water. The running problem could be overcome by evacuating the riser pipe with pressurized air or gas. Preferably, the inserts are "pulled" down by a heavy bar attached to the lower end of the sleeve insert.

DRAWINGS

A better understanding of the invention may be had from the following detailed description taken in conjunction with the drawings, in which FIG. 1 illustrates a conventional riser pipe system;

DETAILED DESCRIPTION

Figure 1:
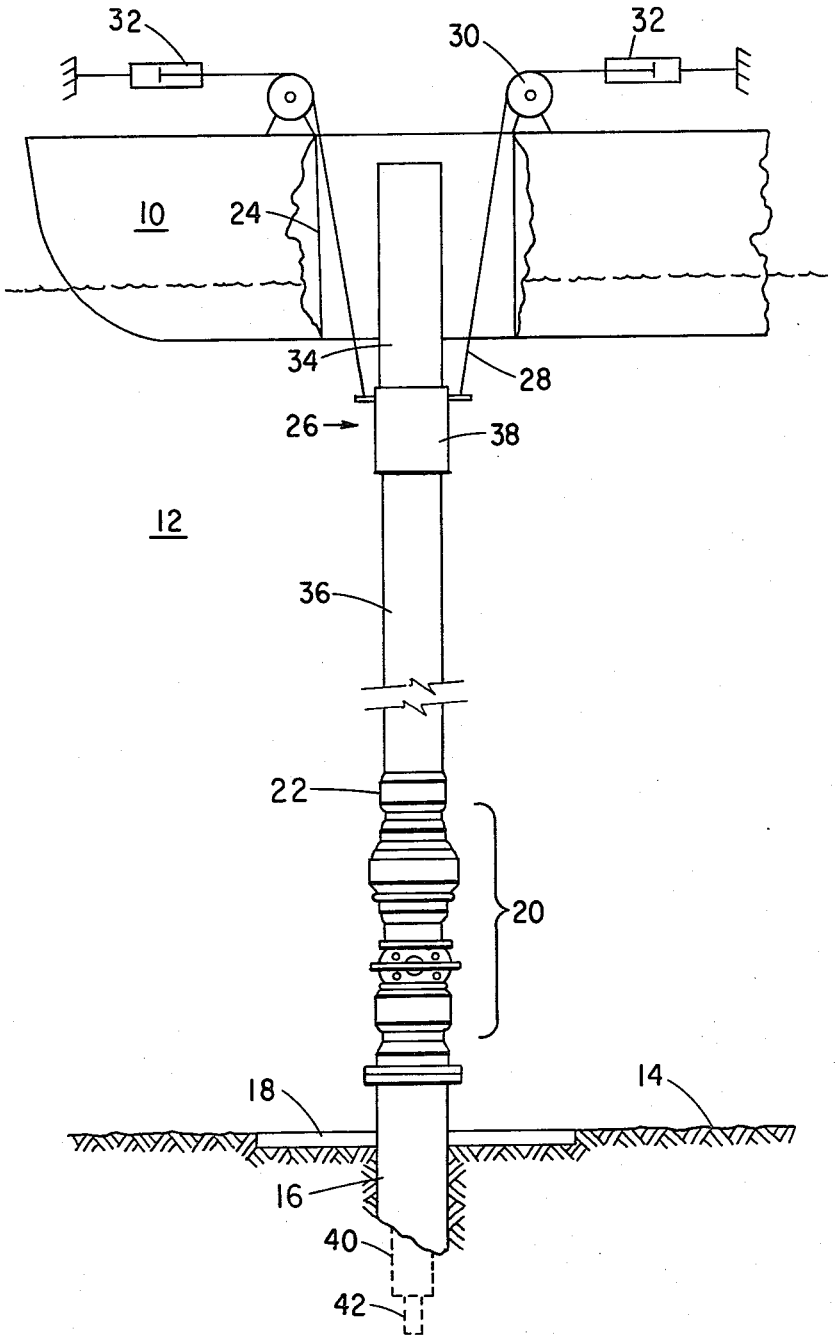

Attention is first directed to FIG. 1 which shows a conventional riser pipe system extending from a ship 10 to a wellhead assembly 20. The ship is supported by a body of water 12 having a bottom 14. The vessel 10 is anchored by means not shown above the well in the ocean floor which is cased with surface casing 16, for example. Surface casing 16 is attached to a pad or other anchor means 18. Surface casing 16 and pad 18 can be cemented or otherwise secured to the ocean floor so that, in effect, they form an anchor. Mounted at the top of surface casing 16 is the wellhead assembly 20 which normally includes blowout preventers. The term "wellhead," as used herein, means any structure on the bottom of a body of water to which a riser pipe can be connected for drilling operations. Mounted on the upper end of a wellhead assembly 20 is the lower portion of a ball and socket joint 22 which mates with the lower end of the riser pipe assembly 26.

Vessel 10 has a well or moonpool 24, in which is suspended riser pipe 26 by cables 28. Cables 28 go over pulleys 30 to a tensioning means 32 which are supported from the vessel. Riser pipe assembly 26 includes an upper section 34 and a lower section 36. A slip joint 38 is provided within which upper section 34 is free to reciprocate. Thus, cables 28 are effectively connected to the lower section 36 so that tension can be applied to it by tensioning means 32.

Typical diameters of riser pipe 36 are 20 inches or $18\frac{5}{8}$ inches. In drilling the well through the system of FIG. 1, after a first selected depth is reached, a string of casing is run. This casing string is indicated by dotted lines 40 and typically could be a $9\frac{5}{8}$ in. casing string which may be set for several thousand feet into the ground. If additional hole is drilled after the casing 40 is set, an additional casing string indicated at 42 is set. Typically, this could be a $6\frac{7}{8}$ in. casing. Casing strings 40 and 42 are hung off at the mudline in a known manner.

Figure 2:
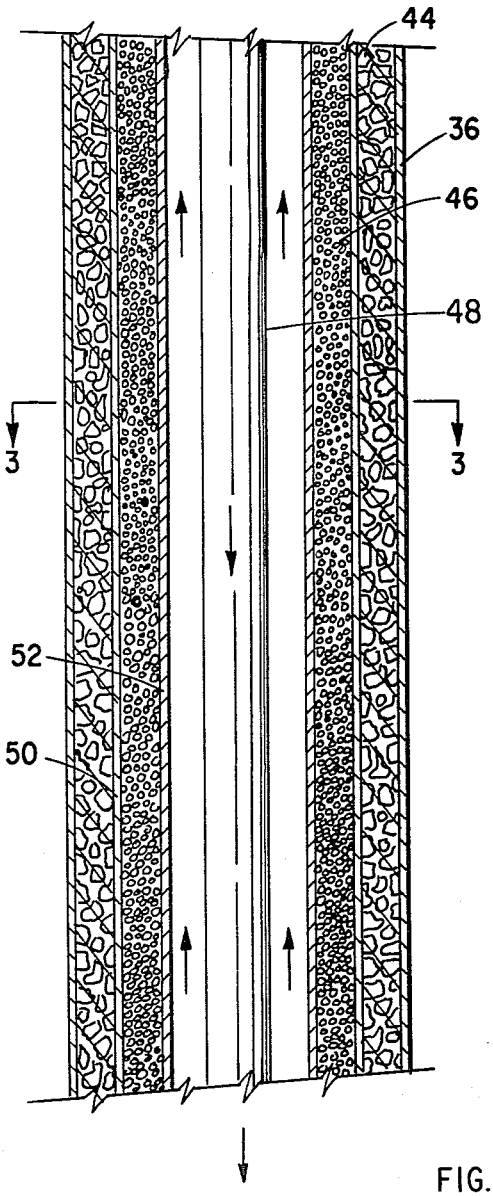
FIG. 2 illustrates partly in section a segment of a riser pipe having sleeves inserted therein.
Figure 3:
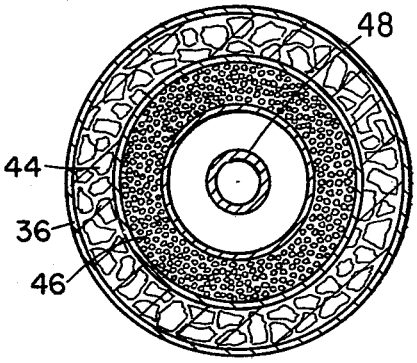
FIG. 3 is a section view taken along the line 3—3 of FIG. 2.

Ideally, every time a string of casing is placed in the well, such as casing strings 40 and 42, one would need a new and smaller riser in order to maintain about the same drilling fluid upward velocity as in the casing string, and thus maintain unchanged the cuttings-carrying capacity of the circulating drilling fluid. In my invention, I use only one marine riser, but high upward fluid velocity is obtained after a string of casing is placed. Reference is now made to FIGS. 2 and 3. After a first string of casing 40 is run through riser pipe 26 and is set (surface casing 16 is not run through the riser pipe), I place sleeve 44 in riser 36. The internal diameter of sleeve 44 is sufficiently large to permit the running of the next smaller anticipated size of casing. A drill string 48 runs within the interior of the sleeve 36. After placing sleeve 44 in the riser, I continue drilling with drill string 48 and the bit, not shown, in the normal manner. After I have drilled to a desired depth, I set casing 42. Again, it is desirable to have a smaller riser effective diameter. I obtain this by running a second sleeve 46 inside the first sleeve 44. These sleeves can be made of a material only slightly denser than sea water. As one gallon of sea water weighs about 9 pounds, a sleeve which has the density of sea water in displacing drilling mud which may weigh up to 23 pounds per gallon greatly reduces the tension which needs to be applied at the surface to the riser.

If the sleeves are made of a material denser than sea water, the riser can be first filled with sea water and then the sleeves are merely dropped in place. Once in place, the sleeves can be locked or latched to the riser in any known conventional manner. The sleeves 44 and 46 are preferably made of some foam type of material with a metal interior lining 50, 52 to protect the foam sleeve when running casing or pulling the drill bit.

Figure 4:
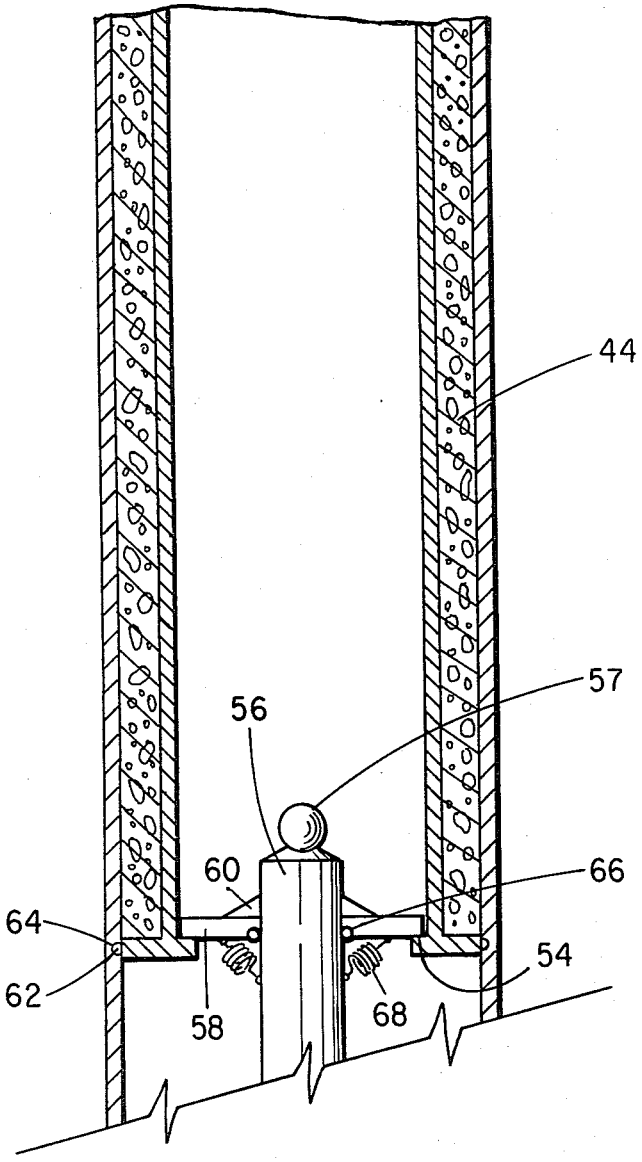
FIG. 4 illustrates means for pulling the sleeve insert downwardly into engagement with a latch on the interior of the riser pipe.

If the density of the sleeves is less than that of the fluid within the riser pipe, special care must be given to the placing of the sleeves in the riser. One possible way of doing this is to evacuate the riser and replace the liquid with a lighter liquid or a gas. Then the sleeves can be lowered readily and latched into position with a known latching means. Many times it is not practical to evacuate the fluid within the riser; thus, suitable means must be provided for pulling the sleeves downward into position so that they can be latched into place. One such means is illustrated in FIG. 4. As can be seen in FIG. 4, only one sleeve section 44 is shown. The lower end of sleeve 44 has an interior lip 54 which is used for pulling the sleeve downward. The force transmitting means for pulling the sleeve downward can be a heavy bar 56. The upper end of bar 56 has radial arms 58, which extend outwardly and engage lip 54. Wedges 60 limit the upward movement of arms 58 to a horizontal position. In operation, the lower end of sleeve 44 is inserted in the upper end of the riser pipe with bar 56 inserted into the position shown in FIG. 4, so that arms 58 strike lips 54. The downward gravity force of bar 56 pulls the sleeve downward. Only one section of the sleeve is shown, several joints or sections of the sleeve can be put together to fabricate a sleeve of the proper length. This is similar to merely adding on additional joints to drill pipe. When the sleeve 44 has reached its lowest point, latch 62 will latch into detent 64. Any suitable latching means 62—64 can be used. If desired, remotely releasable latching means can be used. When the sleeve 44 is latched in place, bar 56 can be removed by normal fishing operations on fishing neck 57 of the bar 56. If desired, arms 58 of sub 56 can be pivoted about pivots 66 and biased downwardly by spring 68 so that on upward movement, arms 58 are held in a position adjacent bar 56.

While the above has been described in detail, various modifications can be made therefrom without departing from the spirit or scope of the invention.

What I claim is:

1. A method of operation in a body of water using an offshore floating drilling structure and a subsea well in which drilling mud is used and which comprises:

connecting a riser pipe between said floating drilling structure and said well;

maintaining tension on said riser pipe;

drilling a hole by operations conducted through said riser pipes;

running a first string of casing through said riser pipe and setting it in said hole;

running a sleeve insert having an exterior diameter along substantially its entire length which is only slightly less than the internal diameter of said riser pipe and a density only slightly greater than that of said water in said riser with its lower end above said subsea well to effectively reduce the volume of space in said riser pipe and to effectively reduce the tension to be maintained on said riser pipe; and continue drilling operations through said sleeve insert and said first string of casing.

2. An apparatus, for use with a drilling structure floating on a body of water, in a rotary drilling operation in which a drilling mud is circulated which comprises:

a riser pipe connected between said drilling structure and a subsea wellhead; and a sleeve insert in said riser pipe having a hard liner inside an annular foam-type material and also having an external diameter over substantially its entire length which is only slightly less than the internal diameter of said riser pipe, the density of such sleeve insert being only slightly greater than that of said water which in effect reduces tension required on said riser pipe.

3. An apparatus as defined in claim 2 including means for holding said sleeve insert in place.

4. A method of operation in a body of water using an offshore floating drilling structure and a subsea well in which drilling mud is used and which comprises:

connecting a riser pipe between said floating drilling structure and said subsea well;

drilling a hole by operations through said riser pipe while applying tension thereto;

running a first string of casing through said riser pipe and setting it in said hole;

running a sleeve insert, of less length than that of said riser pipe and having a density greater than that of said water but less than that of said mud, in said riser pipe with the lower end of said sleeve insert above said subsea well to effectively reduce the volume in said riser pipe and to effectively reduce the required tension applied to said riser pipe, the lower end of said sleeve insert not being in sealing contact with said wellhead, and said sleeve insert having an outside diameter over substantially its entire length which is only slightly less than the inside diameter of said riser pipe; and continue drilling through said sleeve insert and said first string of casing.

5. An apparatus for use with a drilling structure floating on a body of water, in a rotary drilling operation in which a drilling mud is circulated which comprises:

a riser pipe connected between said drilling structure and a subsea wellhead;

means to apply tension to said riser pipe; and a sleeve insert in said riser pipe having a cross-sectional size to substantially fill the annulus between the bore of the sleeve insert and said riser pipe along substantially the full length of the sleeve, the density of said sleeve insert being greater than that of the sea water but less than that of said mud to effectively reduce the tension required on said riser pipe, said sleeve being of less length than said riser pipe and the lower end of said sleeve insert not being in sealing contact with said wellhead.

6. A method of operation in a body of water using an offshore floating drilling structure and a subsea well in which drilling mud is used and which comprises:

connecting a riser pipe between said floating drilling structure and said well;

drilling a hole by operations conducted through said riser pipe;

running a first string of casing through said riser pipe and setting it in said hole;

running a sleeve insert having a density only slightly greater than that of said water in said riser with its lower end above said subsea well to effectively reduce the volume of space in said riser pipe;

continue drilling operations through said sleeve insert and said first string of casing;

running a second string of casing through the interior of said first sleeve insert and setting same in place; and thereafter running a second sleeve insert inside said first sleeve insert, the interior diameter of said second sleeve insert being not greater than the internal diameter of said second string of casing.

* * * * *